US006053312A

United States Patent [19]

Smith

[11] Patent Number: 6,053,312

[45] Date of Patent: Apr. 25, 2000

[54] GOLF BAG SECURITY DEVICE

[76] Inventor: Allen Smith, 18 Swift Ct., Newport Beach, Calif. 92663

[21] Appl. No.: 09/277,108

[22] Filed: Mar. 26, 1999

[51] Int. Cl.[7] ..... A63B 55/04

[52] U.S. Cl. ..... 206/315.6; 211/70.2; 70/58

[58] Field of Search ..... 206/315.3, 315.6, 206/315.4; 70/58, 4, 18, 19; 211/70.2

[56] References Cited

U.S. PATENT DOCUMENTS

| | | | |
|---|---|---|---|
| 4,863,019 | 9/1989 | Lewis et al. | 206/315.3 |
| 5,004,100 | 4/1991 | Smith | 206/315.3 X |
| 5,590,772 | 1/1997 | Schuhlen et al. | 206/315.3 |
| 5,636,735 | 6/1997 | Stusek | 206/315.3 X |
| 5,862,909 | 1/1999 | Jacobsen | 206/315.3 |

*Primary Examiner*—Stephen P. Garbe
*Assistant Examiner*—Tri M. Mai
*Attorney, Agent, or Firm*—Edgar W. Averill, Jr.

[57] ABSTRACT

A golf bag security device for locking golf clubs in a golf bag. The security device is positioned at the top of the golf bag and has a guide member with a hole through it, one for each club. A pair of bars having a fork positionable under each hole is held below the openings and may be moved from a locked position to an unlocked position. In an unlocked position it is possible to insert and retrieve a golf club freely. When the device is locked with a golf club in the bag, the golf club can be pulled up only until the grip is contacted by the forks. This prevents the club from being removed from the bag.

15 Claims, 4 Drawing Sheets

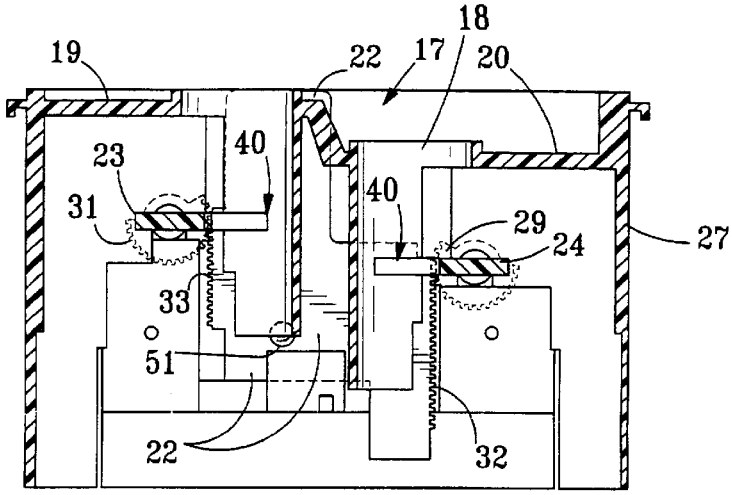
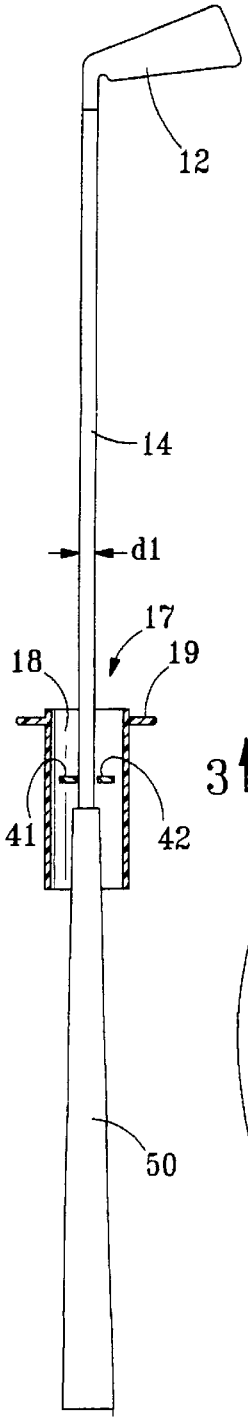
FIG. 4
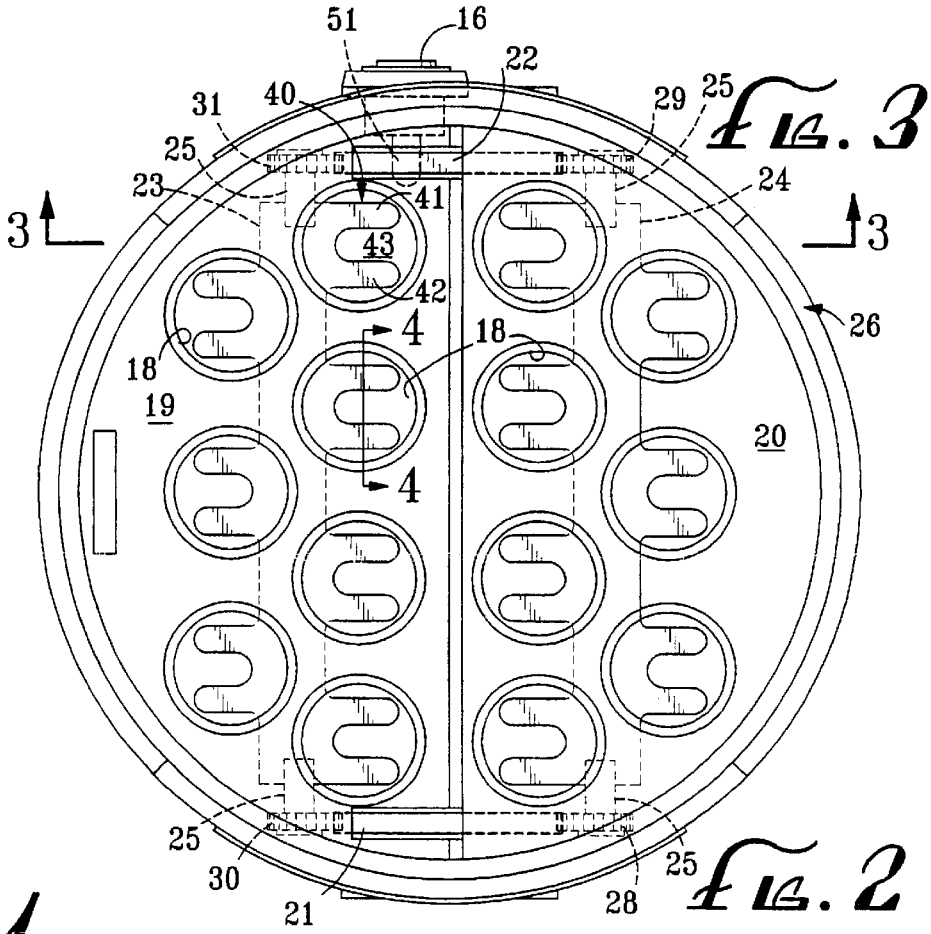
FIG. 3
FIG. 2

GOLF BAG SECURITY DEVICE

BACKGROUND OF THE INVENTION

The field of the invention is accessories related to the sport of golf and the invention relates more particularly to security devices for locking golf clubs so that they cannot be removed from a golf bag when so locked.

With the increase in the cost of golf clubs combined with an increase in theft, it has become worthwhile to lock a golfer's golf clubs in the golf bag which, in turn, can be locked to a golf bag rack. A number of patents have been issued for such devices. U.S. Pat. No. 5,524,753 shows such a lock which is brought about by a series of slots in three plates. The center plate is slidable to narrow the width of the slots and lock the golf clubs within the bag.

U.S. Pat. No. 5,636,735 has three sets of plates with holes therethrough. The plates are turned relative to one another to narrow the openings in the top plate and secure the clubs from being withdrawn from the bag. A lock over the golf bag is shown in U.S. Pat. No. 4,863,019. A different series of plates form a locking member in U.S. Pat. No. 5,267,660.

Since golf clubs come in different heights, it is advantageous to have a golf club lock which can be configured to provide at two different levels, one for woods and long irons and the other for a putter and short irons.

BRIEF SUMMARY OF THE INVENTION

It is an object of the present invention to provide a device for locking golf clubs in a golf bag which is unobtrusive, easy to operate and permits a different area for longer clubs than that for shorter clubs.

The present invention is for a golf bag security device which has a guide member with openings through which the golf club handles may be passed. A pair of multi-forked lock bars are supported below the openings and may be moved between a vertical position and a horizontal position. When the fork bars are in a horizontal position, the clubs are free to move in and out of the openings, however, when the forked locked bar is moved into a horizontal position, the forks position themselves under the openings and prevent the clubs from being removed past the beginning of the grip portion of the club. Preferably, the lock bars are manipulated by a rack and pinion mechanism.

BRIEF DESCRIPTION OF THE DRAWINGS

FIG. 2 shows a top view of the security device of FIG. 1A.

FIG. 3 is a cross-sectional view taken along line 3—3 of FIG. 2.

FIG. 4 is a cross-sectional view taken along line 4—4 of FIG. 2.

DESCRIPTION OF THE PREFERRED EMBODIMENTS

Figure 1B:
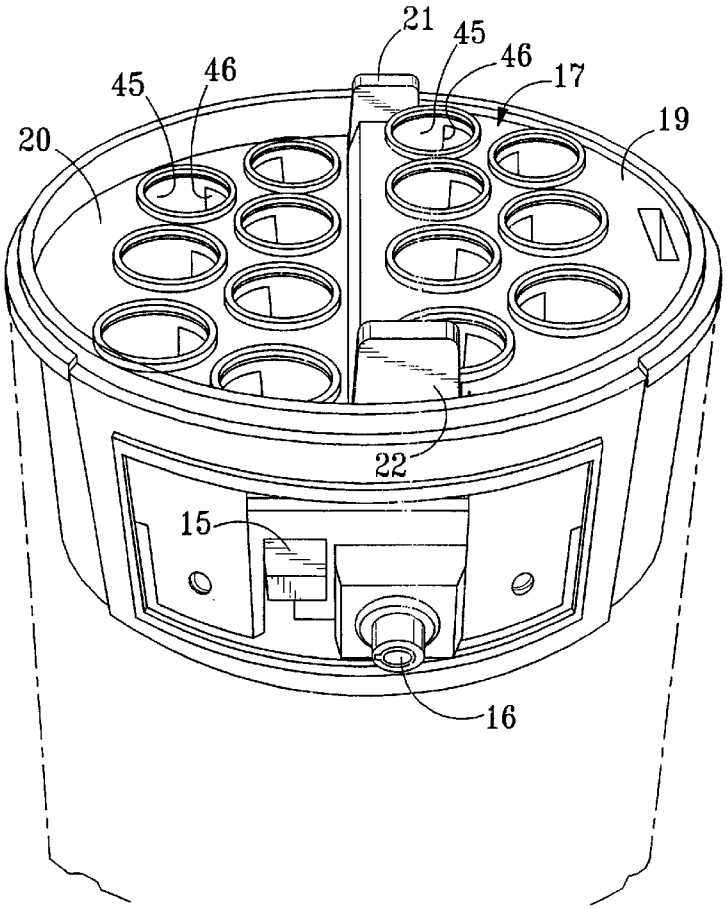
FIG. 1B shows the device of FIG. 1A in an unlocked configuration.
Figure 1A:
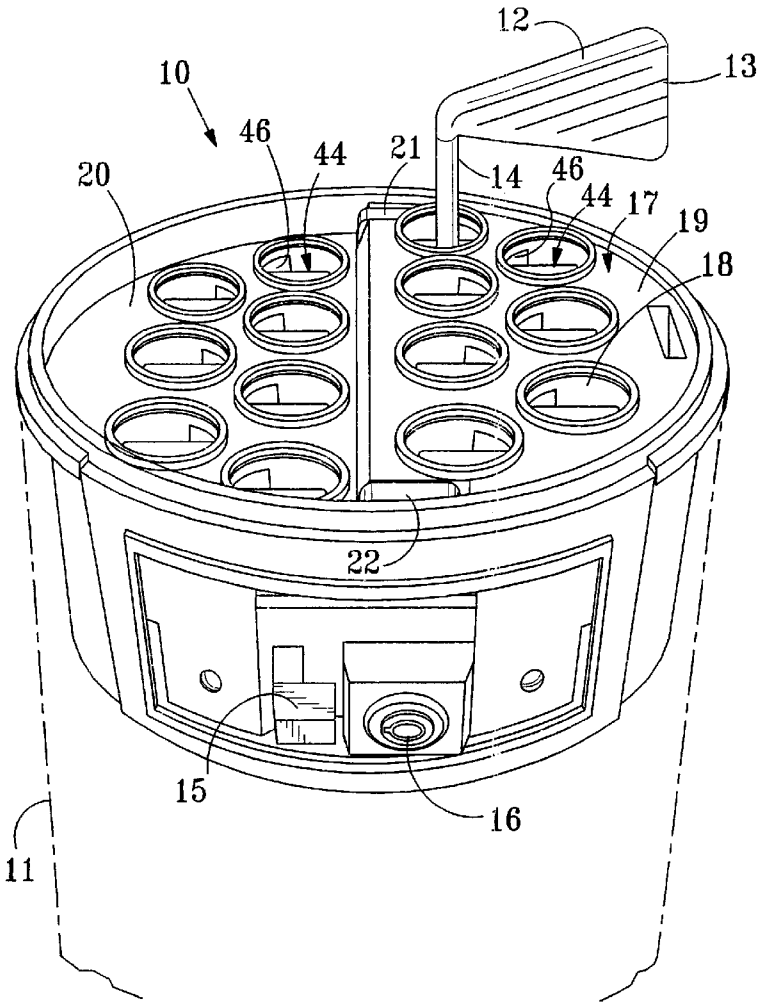
FIG. 1A shows the top and front view of the golf bag security device of the present invention shown in a locked configuration.

The golf bag security device of the present invention is shown in perspective view in FIG. 1A in a closed configuration and indicated generally by reference character 10. The device is shown affixed to the top of a golf bag 11 shown in phantom view. A golf club 12 having a head 13 and a shaft 14 having a shaft diameter range is locked in security device 10. This locking is superficially brought about by moving locking handle 15 downwardly and pushing in on push button lock 16. The locking mechanism operates below a guide member 17 which has a plurality of club support apertures 18.

Guide member 17 has an upper level 19 which is preferably used for longer clubs such as woods and long irons. A lower level 20 of guide member 17 is useful for shorter clubs, such as the putter and short irons.

In FIG. 1B the same device is shown in an open configuration where a pair of extensions of rack support bars 21 and 22 of the locking mechanism can be used to activate the locking mechanism instead of the movement of handle 15. Push button lock 16 is shown in an extended or unlocked configuration in FIG. 1B.

Turning to FIG. 2, the locking mechanism begins to become evident. A pair of multi-forked lock bars 23 and 24 are held by shafts 25 to the frame 26. Frame 26 has a vertical portion 27 as well as an integral guide member 17. It can also be seen in FIG. 2 in phantom view that each of the shafts 25 is connected to a pinion or quadrant gear 28, 29, 30 and 31. Gears 29 and 31 can be seen in FIG. 3 where a pair of racks 32 and 33 are affixed to a rack supporting bar 22.

When handle 15 is lifted, rack support bar 22 is raised and racks 32 and 33 move upwardly, moving multi-forked lock bar 24 in a clockwise twisting movement. At the same time, multi-forked lock bar 23 is moved in a counter clockwise configuration to an unlocked position which is vertical and shown in FIG. 6.

Returning to FIG. 2, it can be seen that multi-forked lock bar 23 has a plurality of forks, such as fork 40, which have a pair of parallel tines 41 and 42 and a shaft-spanning space 43. Shaft-spanning space 43 is, of course, large enough to surround the shaft, but too small to permit the passage of grip 50.

Figure 6:
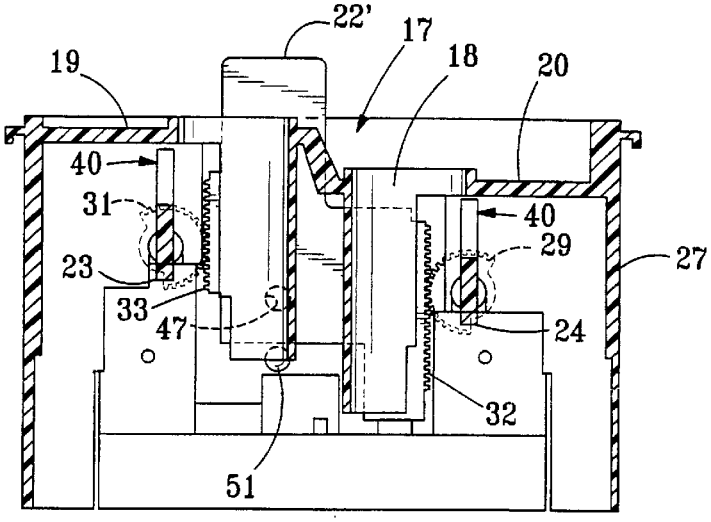
FIG. 6 is a cross-sectional view taken along line 6—6 of FIG. 5.
Figure 7:
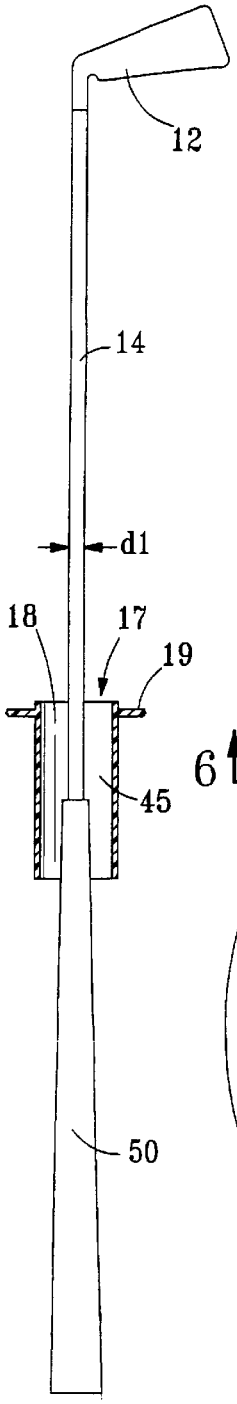
FIG. 7 is a cross-sectional view taken along line 7—7 of FIG. 5.
Figure 5:
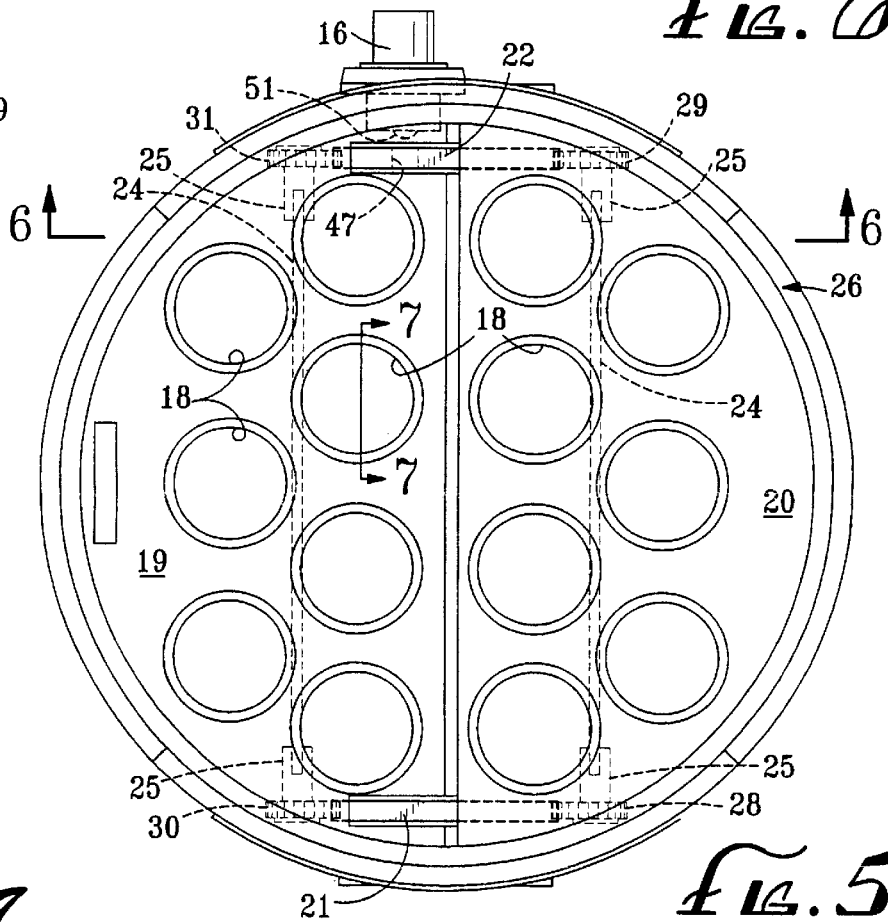
FIG. 5 is a top view of the device of FIG. 1B.
Figures 8, 9:
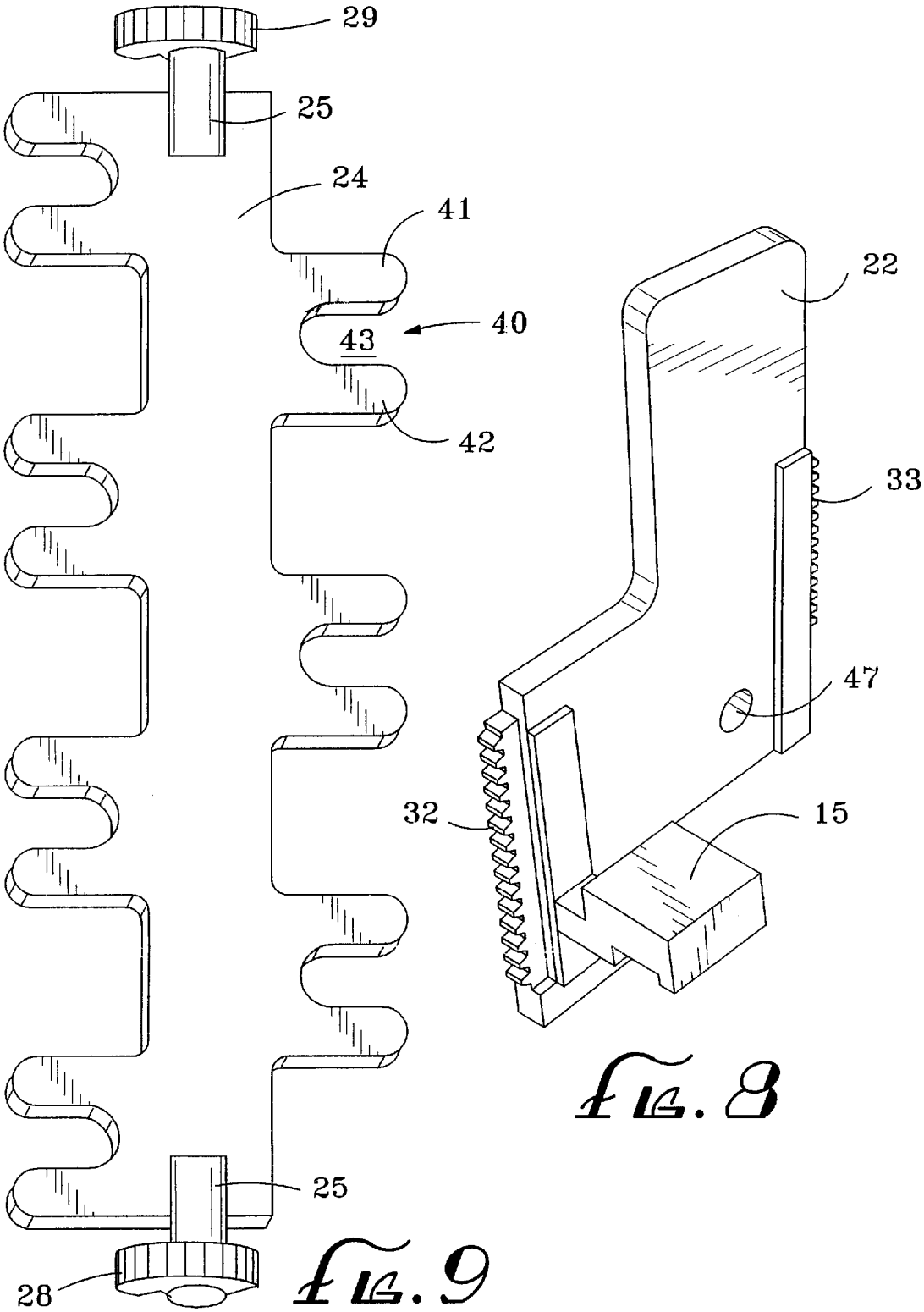
FIG. 8 is a perspective view of the rack support bar and locking handle assembly of the present invention.
FIG. 9 is a bottom perspective view of one of the lock bars of the device of the present invention.

This holding action is further enhanced by notched cylindrical channels 45. Thus, one cannot remove a club by pulling it part way out and then angling the upper part of the club, since as shown partly in FIG. 1A, the tines 44 pass through notches 46. The details of construction of the multi-forked lock bar 24 are shown in FIG. 9. Also evident from FIG. 2 is that push button lock 16 has a lock pin 51 which passes through a lock opening 47 (FIG. 8) when the push button 16 is depressed. Conversely, when the lock is unlocked, as shown in FIG. 1B, lock pin is withdrawn from lock opening 47. The device in an open configuration is shown in FIGS. 5, 6 and 7. In FIG. 6 the extending end 22' of rack support member 22 is shown in side view. In FIG. 7 the side view of the notched cylindrical channel 45 is shown.

While a series of forked members with a pair of tines is shown in the drawings, it is, of course, conceivable that other shapes of blocking members could be used. For instance, a rounded triangular member in place of a fork could be shaped to move into notched cylindrical channels. Although the forks are shown as being rotated into position, it is also contemplated that they could be moved sideways into position instead, although rotation is preferred.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A golf bag security device for locking golf clubs in a golf bag comprising:

at least one golf club held by said golf bag security device, said golf club having a shaft having a shaft diameter range and a handle having a handle diameter range;

a guide member which is generally horizontal when golf clubs, held by the device, are generally vertical, said guide member having a plurality of club shaft apertures through which a golf club handle and shaft may be passed when said security device is in an unlocked position;

a frame having a generally vertical portion and having side wall portions and supporting said guide member at a top end thereof;

at least one multi-forked lock bar supported by said frame, said at least one multi-forked lock bar having a plurality of forks extending from at least one side thereof, each of said forks having a pair of tines separated by a shaft-spanning space having a shaft-spanning width which width is wider than said shaft diameter range and narrower than said handle diameter range, said at least one multi-forked lock bar being movable from a locked position wherein at least one of said shaft-spanning spaces is below at least one of said golf club shaft apertures in said guide members a sufficient distance to prevent a golf club handle to be blocked from withdrawal through said at least one shaft-spanning spaces to an unlocked position wherein said at least one of said shaft-spanning spaces is retracted sufficiently to permit the golf club handle to be withdrawn through said golf club shaft apertures; and means for moving said at least one multi-forked bar between a locked position and an unlocked position.

2. The golf club bag security device of claim 1 wherein said at least one multi-forked lock bar is moved from a locked position to an unlocked position by rotating said at least one multi-forked lock bar through an arc from a locked position to an unlocked position.

3. The golf club bag security device of claim 2 wherein said at least one multi-forked lock bar is rotated from a locked configuration where it is about horizontal to an unlocked position where it is about vertical.

4. The golf club bag security device of claim 2 wherein said at least one multi-forked lock bar is a flat bar with a top, a bottom, a first side, and a second side, and has a plurality of forks on both said first side and said second side.

5. The golf club bag security device of claim 4 wherein said plurality of forks on the first side is offset from the plurality of forks on the second side.

6. The golf club bag security device of claim 5 wherein there are two multi-forked lock bars.

7. The golf club bag security device of claim 2 wherein said at least one multi-forked bar has a pinion affixed to at least one end of said at least one multi-forked bars.

8. The golf club bag security device of claim 7 wherein said at least one multi-forked bar is moved through an arc by the vertical movement of a rack.

9. The golf club bag security device of claim 8 wherein there is a pinion and a rack at each end of said at least one multi-forked lock bar has a pinion and a rack at each end thereof.

10. The golf club bag security device of claim 9 further including a locking mechanism which inserts and withdraws a pin into and out of an aperture in one of said racks.

11. A golf bag security device for locking golf clubs in a golf bag comprising:

at least one golf club held by said golf bag security device, said golf club having a shaft having a shaft diameter range and a handle having a handle diameter range;

a guide member which is generally horizontal when golf clubs, held by the device are generally vertical, said guide member having a plurality of club shaft apertures through which a golf club handle and shaft may be passed when said security device is in an unlocked position and wherein each of said club shaft apertures has a semi-cylindrical guide extending below each aperture;

a frame having a generally vertical portion and having side wall portions and supporting said guide member at a top end thereof;

two lock bars supported by said frame, each of said lock bars having a plurality of blocking members extending from at least one side thereof, each of said blocking members having at least one arm which may be moved through an arc below said club shaft apertures and into said semi-cylindrical guides so as to form an opening larger than said shaft diameter range and smaller than said handle diameter range below each of said plurality of club shaft apertures; and means for turning said lock bars between a locked position and an unlocked position.

12. The golf club bag security device of claim 11 wherein said means for turning said lock bars comprises a rack and pinion assembly at both ends of each of said bars.

13. The golf club bag security device of claim 12 wherein said rack and pinion assembly comprises a rack and pinion at a first end and a rack and pinion at a second end of a first lock bar, and a rack and pinion at a first end and a rack and pinion at a second end of a second lock bar.

14. The golf club bag security device of claim 13 wherein each of said pinions is affixed to a lock bar and each of said racks is held by an actuating assembly vertically movably supported by said frame.

15. The golf club bag security device of claim 11 wherein said guide member has an upper portion with a first plurality of club shaft apertures and a lower level with a second plurality of club shaft apertures.

* * * * *